US010107287B2

(12) United States Patent
Kim et al.

(10) Patent No.: US 10,107,287 B2
(45) Date of Patent: Oct. 23, 2018

(54) BALANCE SHAFT MODULE

(71) Applicant: HYUNDAI MOTOR COMPANY, Seoul (KR)

(72) Inventors: Seongyong Kim, Gunpo-si (KR); Sung Kwang Kim, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 15/333,886

(22) Filed: Oct. 25, 2016

(65) Prior Publication Data

US 2017/0314556 A1 Nov. 2, 2017

(30) Foreign Application Priority Data

Apr. 29, 2016 (KR) ..... 10-2016-0053121

(51) Int. Cl.

| | |
|---|---|
| ***F04C 15/00*** | (2006.01) |
| ***F01M 1/02*** | (2006.01) |
| ***F04C 2/14*** | (2006.01) |
| ***F04C 13/00*** | (2006.01) |
| ***F04C 2/10*** | (2006.01) |

(52) U.S. Cl.

CPC ..... *F04C 15/0061* (2013.01); *F01M 1/02* (2013.01); *F04C 2/10* (2013.01); *F04C 2/14* (2013.01); *F04C 13/00* (2013.01); *F04C 13/001* (2013.01); *F04C 15/008* (2013.01); *F01M 2001/0238* (2013.01); *F01M 2001/0269* (2013.01); *F04C 2240/50* (2013.01); *F04C 2240/60* (2013.01); *F04C 2270/13* (2013.01)

(58) Field of Classification Search

CPC ..... F04C 15/0061; F04C 13/001; F04C 2/14; F04C 15/008; F04C 2240/50; F04C 2270/13; F01M 1/02; F01M 2001/0269; F01M 2001/0238

See application file for complete search history.

(56) References Cited

U.S. PATENT DOCUMENTS 4,687,411 A * 8/1987 Maeda ..... F16C 35/02 384/538

6,205,970 B1 3/2001 Iwata et al.

(Continued)

FOREIGN PATENT DOCUMENTS

JP 2006-046456 A 2/2006

JP 5478599 B2 4/2014

(Continued)

*Primary Examiner* — Jacob Amick

*Assistant Examiner* — Charles Brauch

(74) *Attorney, Agent, or Firm* — McDermott Will & Emery LLP

(57) ABSTRACT

A balance shaft module includes a balance shaft for receiving a driving force from a crankshaft of an engine by a driving gear and rotating inside a balance shaft housing, an oil pump gear being geared with the driving gear to rotate along with the driving gear, an oil pump shaft having the oil pump gear press-fitted therein and rotating as the oil pump gear rotates, and an oil pump assembly mounted in the oil pump shaft and pumping oil as the oil pump shaft rotates, wherein a pair of support rings is provided at both side surfaces of the oil pump gear to support both side portions of the oil pump gear in the oil pump shaft.

15 Claims, 6 Drawing Sheets

(56) References Cited

U.S. PATENT DOCUMENTS

| | | | | |
|---|---|---|---|---|
| 2008/0156563 | A1* | 7/2008 | Shiozaki | F01P 5/12 180/219 |
| 2008/0238266 | A1* | 10/2008 | Moriyama | H02K 1/2793 310/67 R |
| 2011/0277720 | A1* | 11/2011 | Jacques | F16F 15/265 123/192.2 |
| 2012/0298068 | A1* | 11/2012 | Lagatta | F01M 1/02 123/196 R |
| 2015/0083068 | A1* | 3/2015 | Sugiura | F16F 15/264 123/192.2 |

FOREIGN PATENT DOCUMENTS

| | | | |
|---|---|---|---|
| KR | 10-2011-0125372 | A | 1/2013 |
| KR | 10-2011-0048176 | | 2/2015 |
| KR | 10-1491173 | B1 | 2/2015 |

* cited by examiner

BALANCE SHAFT MODULE

CROSS-REFERENCE TO RELATED APPLICATION

This application claims the benefit of priority to Korean Patent Application No. 10-2016-0053121, filed with the Korean Intellectual Property Office on Apr. 29, 2016, the entire contents of which are incorporated herein by reference.

TECHNICAL FIELD

The present disclosure relates to a balance shaft module, and more particularly, to a balance shaft module in which an oil pump is integrally mounted in the balance shaft to thereby reduce noise occurring from the oil pump.

BACKGROUND

Generally, an engine may cause vibrations or noise due to an inertial force generated by a reciprocating motion of a piston. To reduce the vibration or noise, various apparatuses are provided. For example, a cylinder block of the engine may be provided with a balance shaft to reduce the vibrations while the balance shaft rotates in an opposite direction to a crankshaft.

The balance shaft is provided with a driving gear and thus rotates due to a driving force from the crankshaft and may be coupled with a driving/driven transmission gear, an intermediate gear, or the like. Further, the balance shaft is provided with a balance weight for stably rotating the balance shaft and an oil pump for pumping oil.

The oil pump includes an oil pump gear, an oil pump shaft, a housing and a rotor part. The oil pump gear receives a rotating force from a gear of the crankshaft of the engine to rotate while being engaged with the oil pump shaft. The rotor part is press-fitted on an outer circumferential surface of the oil pump shaft and rotates when the pump shaft rotates. Further, the oil pump shaft is press-fitted in an inner side of the rotor part.

The housing includes a support surface extending in the axial direction along the outer circumferential surface of the oil pump shaft and a thrust surface extending radially outwardly from the support surface and contacting both surfaces of the rotor part.

When the engine rotates, an angular acceleration of the engine may be changed. A torque generated therefrom is transferred to the oil pump gear through the crank gear. As a result, the oil pump gear, the oil pump shaft and the rotor part all receive an irregular load. In this case, the oil pump shaft may eccentrically rotate due to torsion or bending. The eccentric rotation of the oil pump shaft is transferred to the rotor part press-fitted on the outer circumferential surface thereof. The rotor part is configured to contact the thrust surface of the housing, and therefore when the oil pump shaft eccentrically rotates, a durability thereof may be lowered or may cause irregular noise.

Meanwhile, according to the related art, the oil pump gear and the rotor are press-fitted in the oil pump shaft and the related art has a structure in which only the rotor is enclosed with the housing, in which the housing is integrally formed with the balance shaft housing. Therefore, a backlash control between the driving gear connecting between the balance shaft fixedly mounted in the balance shaft housing and the oil pump shaft and the oil pump gear may not be made. As such, if the appropriate backlash is not performed between the gears, gear whine noise or a rattle noise may occur.

The above information disclosed in this Background section is only for enhancement of understanding of the background of the disclosure and therefore it may contain information that does not form the prior art that is already known in this country to a person of ordinary skill in the art.

SUMMARY

The present disclosure has been made in an effort to provide a balance shaft module in which support rings are mounted at both sides of an oil pump gear and an oil pump shaft and a rotor are spline-coupled to each other, to thereby reduce noise or vibration.

An exemplary embodiment of the present disclosure provides a balance shaft module, including: a balance shaft receiving a driving force from a crankshaft of an engine by a driving gear and rotating inside a balance shaft housing; an oil pump gear geared with the driving gear to rotate along with the driving gear; an oil pump shaft having the oil pump gear press-fitted therein and rotate as the oil pump gear rotates; and an oil pump assembly mounted in the oil pump shaft and pumping oil as the oil pump shaft rotates, in which a pair of support rings may be provided at both side surfaces of the oil pump gear to support both side portions of the oil pump gear in the oil pump shaft.

The balance shaft module may further include: a thrust bearing interposed between an inner side surface of the pair of support rings and both side portions of the oil pump gear and mounted at the oil pump shaft.

The inner side surface of the pair of support rings may be provided with a groove into which the thrust bearing is inserted.

The oil pump shaft may be mounted at one side in a width direction of the oil pump housing and the other side in the width direction of the oil pump housing may be provided with a mounting groove dented in an axial direction so that the driving gear of the balance shaft is inserted into the mounting groove to be engaged with the oil pump gear.

The oil pump housing may be provided with a front cover covering one surface of the oil pump gear and the front cover may extend in a width direction to form an axial one side surface of the mounting groove.

The pair of support rings may enclose an outer circumferential surface of the oil pump shaft to prevent bending or torsion of the oil pump shaft in a radial direction or a circumferential direction.

An axial gear cover extending in an axial direction may be formed between the pair of support rings and the pair of support rings and the axial gear cover may be integrally formed to cover both side surfaces and an outer circumferential surface of the oil pump gear, respectively.

The pair of support rings may include: a first support ring covering one surface of the oil pump gear; and a second support ring covering the other surface of the oil pump gear, and the first support ring may be integrally formed with the front cover.

The axial gear cover may be provided with at least one ventilation hole opened in a radial outside.

The oil pump assembly may include: a rotor shaft extending from the oil pump shaft toward the other side in the axial direction; a rotor spline-coupled to the rotor shaft to rotate along with the rotor shaft; and a rotor housing enclosing the rotor.

One surface of the rotor housing may be spaced apart from the second support ring at a predetermined interval and the rotor housing may be integrally formed with the oil pump housing.

The oil pump housing and the balance shaft housing may be coupled to each other in the axial direction and when the driving gear of the balance shaft housing is geared with the oil pump gear, a position of the oil pump housing may move to one side and the other side in a width direction to perform a backlash control.

The other surface of the oil pump housing may be provided with an assembling protrusion protruding in the axial direction, the balance shaft housing may be provided with an assembling hole to accommodate the assembling protrusion, and the assembling protrusion may be fixedly mounted in the assembling hole so that the balance shaft housing is assembled in the oil pump housing.

The oil pump gear may be provided with a plurality of opening holes opened in the axial direction along a circumferential direction.

The balance shaft may include: a first balance shaft mounted with the driving gear and rotating along with the driving transfer gear mounted on an outer circumferential surface thereof; and a second balance shaft having a driven transfer gear rotating the driving transfer gear while being geared therewith mounted on an outer circumferential surface thereof, and the first balance shaft may be disposed at the other side in the width direction of the oil pump housing and the second balance shaft may be disposed at the other side in the axial direction of the oil pump housing.

The first balance shaft and the second balance shaft may be each provided with a balance weight to control a weight balance when a crankshaft rotates.

According to an exemplary embodiment of the present disclosure, the balance shaft module includes the support rings enclosing the outer circumferential surface of the oil pump shaft while supporting both sides of the oil pump gear, thereby primarily isolating an irregular operation or the vibration of the oil pump gear due to the support rings even though the rotation angular acceleration of the engine is changed.

Further, according to an exemplary embodiment of the present disclosure, the oil pump shaft and the rotor are spline-coupled to each other to prevent the irregular operation occurring due to the eccentric rotation of the oil pump shaft from being directly transferred to the rotor, thereby reducing the vibration or the noise.

Further, the backlash control between the oil pump gear and the driving gear of the balance shaft may be made to prevent a gear whine noise or a rattle noise from occurring.

DETAILED DESCRIPTION

Figure 1:
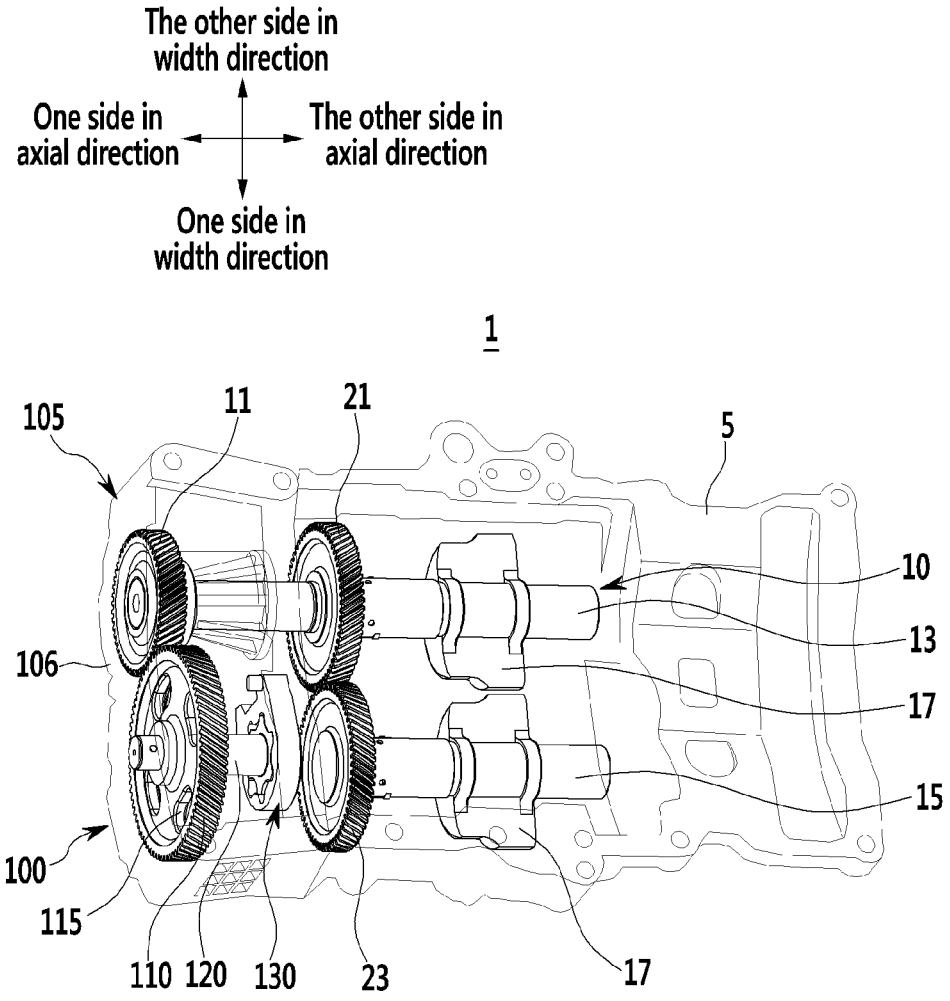
FIG. 1 is a view of a balance shaft module according to an exemplary embodiment of the present disclosure.

The present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

Throughout the specification, unless explicitly described to the contrary, the word "comprise" and variations such as "comprises" or "comprising" will be understood to imply the inclusion of stated elements but not the exclusion of any other elements.

Accordingly, the drawings and description are to be regarded as illustrative in nature and not restrictive. Like reference numerals designate like elements throughout the specification.

For convenience of explanation, the left side in an axial direction in the drawings will be called 'one side', 'one end', 'one end portion', and names similar to them, and the right side in an axial direction in the drawings will be called 'the other side', 'the other end', 'the other end portion', and names similar to them.

Since sizes and thicknesses of the respective components were arbitrarily shown in the accompanying drawings for convenience of explanation, the present disclosure is not limited to contents shown in the accompanying drawings. In addition, thicknesses may have been exaggerated in order to clearly represent several portions and regions.

Hereinafter, an engine system according to an exemplary embodiment of the present disclosure will be described in detail with reference to the accompanying drawings.

Figure 2:
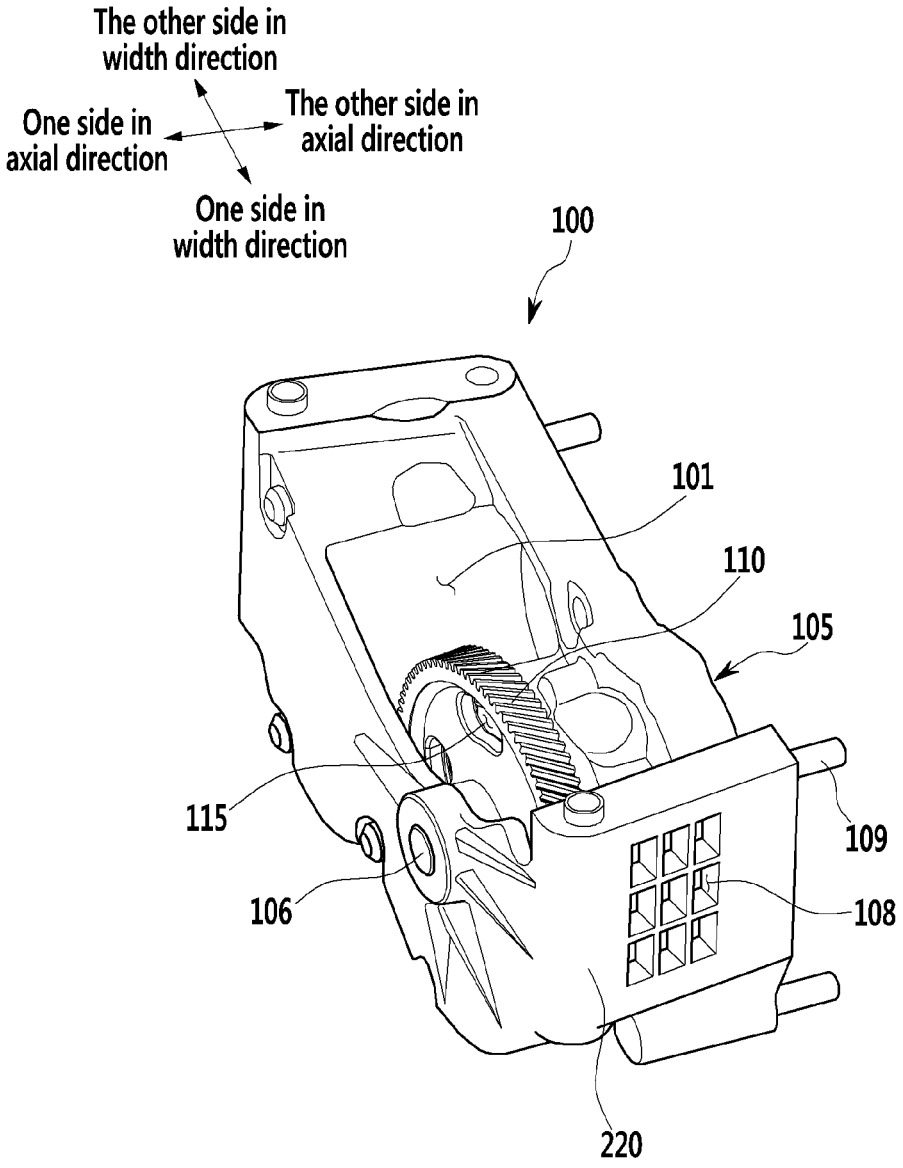
FIG. 2 is a perspective view of an oil pump of a balance shaft module according to an exemplary embodiment of the present disclosure.
Figure 3:
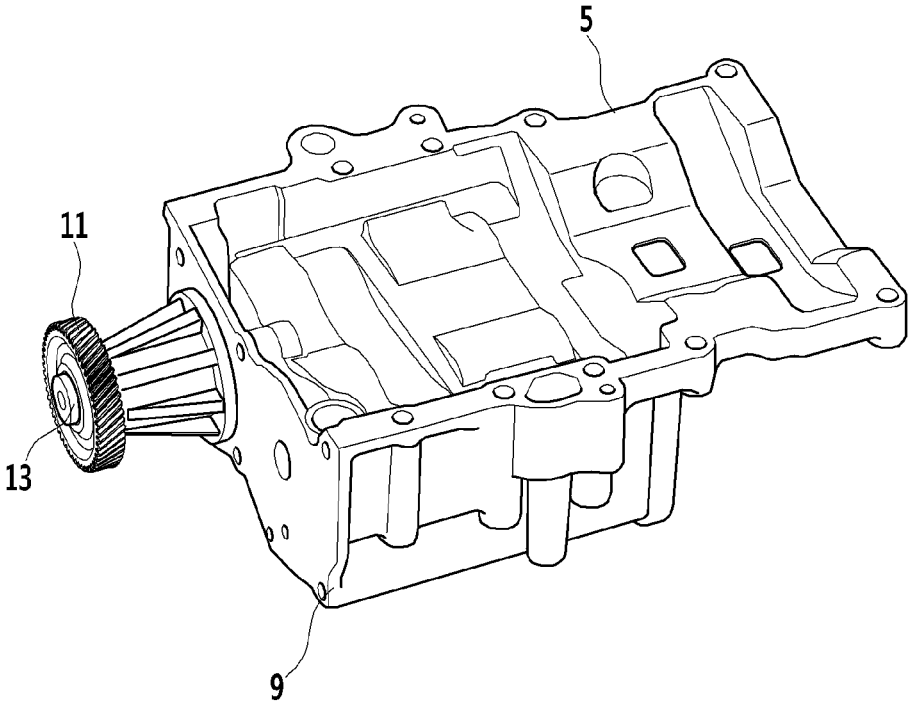
FIG. 3 is a perspective view of a balance shaft part of a balance shaft module according to an exemplary embodiment of the present disclosure.
Figure 4:
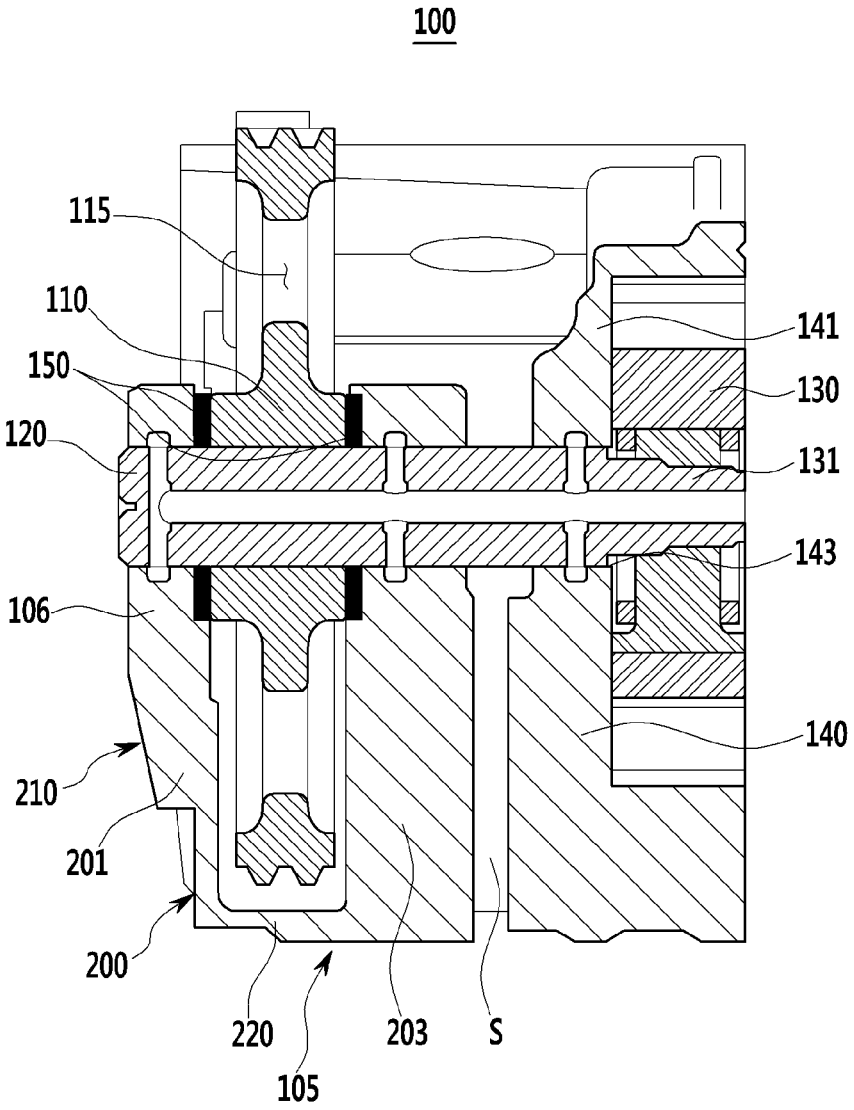
FIG. 4 is a cross-sectional view of a state in which the oil pump of the balance shaft module according to an exemplary embodiment of the present disclosure is assembled.

FIG. 1 is a view of a balance shaft module according to an exemplary embodiment of the present disclosure, FIG. 2 is a perspective view of an oil pump of a balance shaft module according to an exemplary embodiment of the present disclosure, FIG. 3 is a perspective view of a balance shaft part of a balance shaft module according to the exemplary embodiment of the present disclosure, and FIG. 4 is a cross-sectional view of a state in which an oil pump of a balance shaft module according to an exemplary embodiment of the present disclosure is assembled.

As illustrated in FIGS. 1 to 4, a balance shaft module 1 according to an exemplary embodiment of the present disclosure may include a balance shaft 10 receiving a driving force from a crankshaft (not illustrated) of an engine and an oil pump assembly 100 receiving a rotating force from the balance shaft 10 to pump oil.

The balance shaft 10 is mounted at an inner side of a balance shaft housing 5 and may rotate by receiving the driving force of the engine through a driving gear 11. The balance shaft 10 may include a first balance shaft 13 and a second balance shaft 15.

One side in an axial direction of the first balance shaft 13 is provided with a driving gear 11 and an outer circumferential surface of the other side thereof is provided with a driving transfer gear 21 to rotate along with the first balance shaft 13.

The second balance shaft 15 is axially disposed in parallel with the first balance shaft 13 while being spaced apart from the first balance shaft 13 at a predetermined interval in a width direction of the balance shaft housing 5. The driven transfer gear 23 is engaged with the driving transfer gear 21 in the second balance shaft 15, such that the driven transfer gear 23 rotates along with the second balance shaft 15.

The first and second balance shafts 13 and 15 may each be provided with a balance weight 17 to control a weight balance when the crankshaft rotates.

The oil pump assembly 100 receives the driving force from the first balance shaft 13 to pump oil. To this end, the oil pump assembly 100 may include an oil pump gear 110 geared with the driving gear 11 of the first balance shaft 13 to rotate along with the driving gear 11, an oil pump shaft 120 having the oil pump gear 110 press-fitted therein to rotate when the oil pump gear 110 rotates, and a rotor 130 receiving the rotating force from the oil pump shaft 120. The oil pump gear 110 is provided with a plurality of opening holes 115 that are opened in an axial direction along a circumferential direction, thereby reducing weight and costs.

The oil pump assembly 100 is mounted at an inner side of an oil pump housing 105. That is, the oil pump shaft 120 is disposed at one side in a width direction of the oil pump housing 105 and a portion of the first balance shaft 13 and the driving gear 11 are inserted into another side in a width direction of the oil pump housing 105. To this end, as illustrated in FIG. 2, the other side in the width direction of the oil pump housing 105 is provided with a mounting groove 101 to accommodate the first balance shaft 13 and the driving gear 11.

The balance shaft housing 5 of FIG. 3 may be axially coupled to the mounting groove 101 formed at the other side in the width direction of the oil pump housing 105. In this case, the oil pump housing 105 may control appropriate backlash between the driving gear 11 and the oil pump gear 110 while moving to one side and the other side in the width direction. To fixedly assemble the oil pump housing 105 and the balance shaft housing 5, the other surface of the oil pump housing 105 may be protrudedly provided with an assembling protrusion 109 in the other side in the axial direction and one surface of the balance shaft housing 5 may be provided with an assembling hole 9 to accommodate the assembling protrusion 109. As such, the assembling protrusion 109 may be inserted into an assembling hole 9 to more stably promote the assembling of the housings 5 and 105.

Further, the oil pump housing 105 illustrated in FIG. 2 may include a front cover 106 covering one surface of the oil pump gear 110 and an axial gear cover 220 extending in an axial direction from one side in a width direction of the front cover 106 to enclose a radial outside of the oil pump gear 110.

The front cover 106 extends in a width direction to form one side surface in an axial direction of the mounting groove 101. In this configuration, the front cover 106 may cover one surface of the oil pump gear 110 to reduce aeration into the inner side of the front cover and reduce a noise of the oil pump gear 110.

The axial gear cover 220 is provided with a plurality of ventilation holes 108 that are opened in the width direction and may emit heat generated from the oil pump gear 110 or the rotor 130 through the ventilation holes 108 to the outside.

As described above, the oil pump gear 110 receives the driving force from the driving gear 11 to rotate along with the oil pump shaft 120. Further, when an angular acceleration of the engine is suddenly changed, a torque generated therefrom is transferred to the oil pump shaft 120, such that a torsion rotation or bending of the oil pump shaft 120 may occur. According to an exemplary embodiment of the present disclosure, to solve the above problem, as illustrated in FIG. 4, both sides of the oil pump gear 110 are provided with supports 200 for supporting the oil pump gear 110 and the oil pump shaft 120.

The support 200 may include a pair of support rings 210 and the axial gear cover 220 may axially extend between the pair of support rings 210.

The pair of support rings 210 may be disposed on the outer circumferential surface of the oil pump shaft 120 and at both sides of the oil pump gear 110 to prevent the bending or the torsion of the oil pump shaft 120 in the radial direction or the circumferential direction. That is, the pair of support rings 210 may include a first support ring 201 covering one surface of the oil pump gear 110 and a second support ring 203 covering the other surface of the oil pump gear 110 and may be fixedly mounted on the outer circumferential surface of the oil pump shaft 120. The first support ring 201 may be integrally formed with the front cover 106 to fix the oil pump shaft 120 and the oil pump gear 110 and suppress a noise from occurring. The axial gear cover 220 may be disposed between the pair of support rings 210 and integrally formed with the pair of support rings 210 along the outer circumferential surface of the oil pump gear 110, thereby maximizing noise suppression.

Meanwhile, according to an exemplary embodiment of the present disclosure, a thrust bearing 150 may be interposed at the axial inside of the pair of support rings 210 and between both sides of the oil pump gear 110. The thrust bearing 150 is mounted on the outer circumferential surface of the oil pump shaft 120 and is provided to relatively rotate between the pair of support rings 210 that is a fixed element and the oil pump gear 110 that is a rotating element. The thrust bearing 150 may be inserted into the groove formed on surfaces of the pair of support rings 210 to be stably installed, in which arrangement the surfaces face each other.

As such, the thrust bearing 150 may be provided at both sides of the oil pump gear 110 to greatly reduce axial vibrations occurring when the rotating force of the balance shaft 10 is transferred to the oil pump gear 110.

Figure 5:
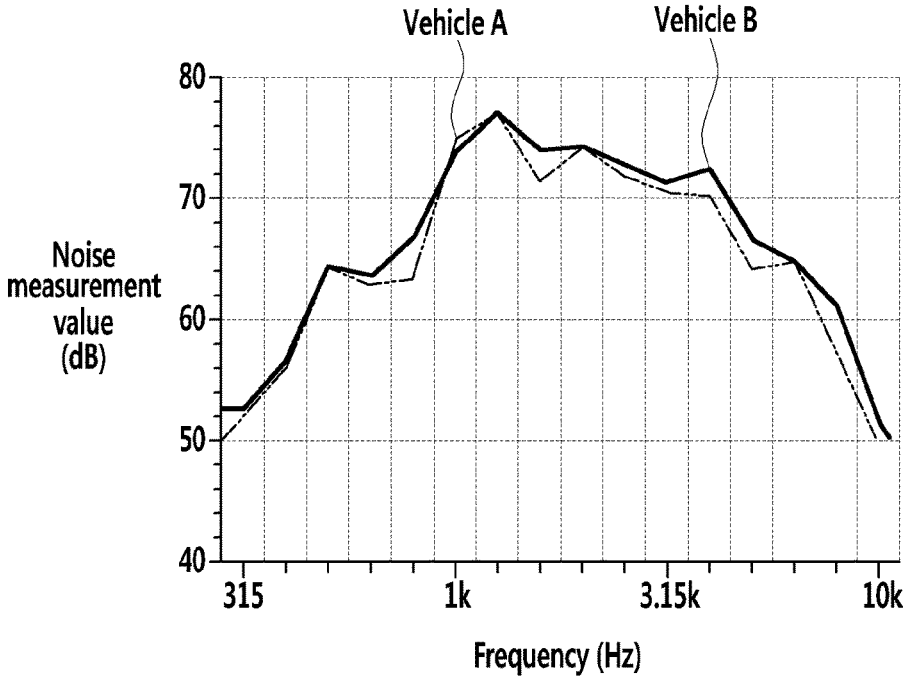
FIG. 5 is a graph illustrating a noise measurement value of a balance shaft module according to an exemplary embodiment of the present disclosure.
Figure 6:
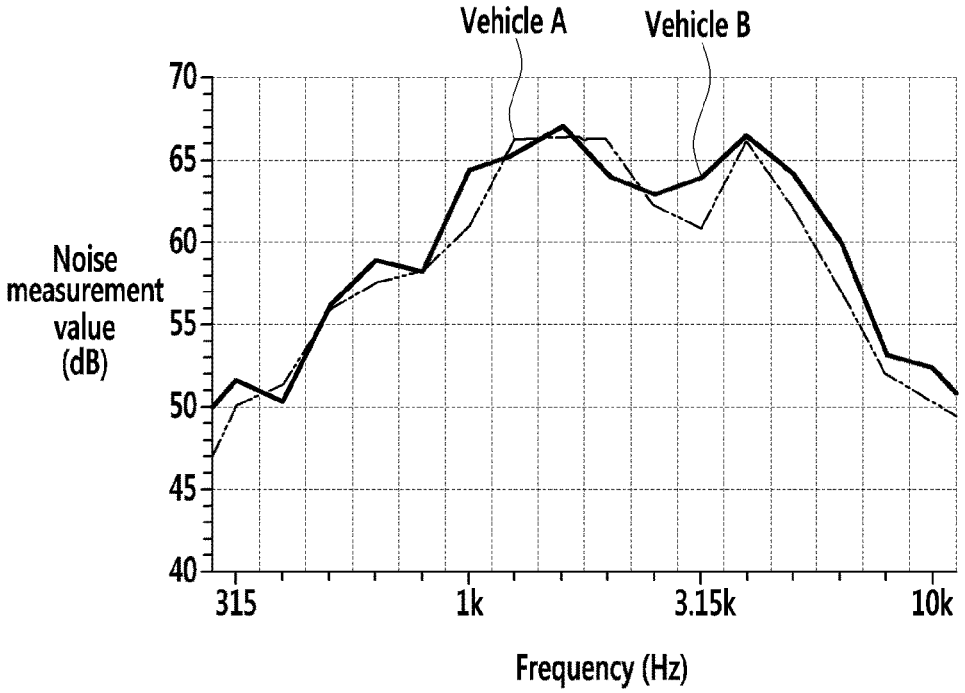
FIG. 6 is a graph illustrating a noise measurement value of a balance shaft module according to the related art.

FIG. 5 is a graph illustrating a noise measurement value of the balance shaft module according to an exemplary embodiment of the present disclosure and FIG. 6 is a graph illustrating a noise measurement value of a balance shaft module according to the related art.

FIGS. 5 and 6 illustrate result values measured when the balance shaft module is spaced apart from the oil pump shaft 120 by a distance of 30 cm downwardly, in vehicle A and vehicle B having similar structures.

Comparing the related art with the present disclosure with reference to FIGS. 5 and 6, it can be appreciated that the related art of FIG. 6 has a noise value of 70 to 80 dB at a frequency of about 1000 kHz, but a noise value of 60 to 65 dB at a similar frequency is produced by the present disclosure of FIG. 5

That is, even though the irregular operation occurs in the oil pump shaft 120, the noise value occurring therefrom may be greatly reduced when employing embodiments of the present disclosure.

The rotor 130 may be mounted at an inner side of the rotor housing 140 to be separated from the outside. One surface of the rotor housing 140 may be provided with a shaft hole 143 through which the oil pump shaft 120 penetrates and a portion of the oil pump shaft 120 penetrates through the shaft hole 143 to transfer the rotating force. The other end of the oil pump shaft 120 may be provided with a rotor shaft 131 that further extends toward the axial other side and the rotor shaft 131 may penetrate through the shaft hole 143 to be inserted into the rotor housing 140.

Further, the rotor 130 may be mounted on the outer circumferential surface of the rotor shaft 131 to rotate along with the rotor shaft 131. A spline may be axially formed on the outer circumferential surface of the rotor shaft 131 and an inner circumferential surface of the rotor 130, and the rotor shaft 131 and the rotor 130 may be spline-coupled to each other through the spline. As such, the rotor shaft 131 and the rotor 130 may be separately coupled to each other, such that it is possible to prevent the vibrations from being directly transferred to the rotor 130 and effectively reduce noise even though the oil pump shaft 120 is irregularly operated or eccentrically rotates.

Further, the rotor housing 140 may be integrally formed with the oil pump housing 105 and a predetermined space S may be formed between one surface thereof and the other surface of the second support ring 203, thereby preventing noise from being transferred into the rotor 130.

As described above, in an embodiment, the first and second balance shafts 13 and 15 are axially disposed in parallel with each other while being spaced apart from each other at a predetermined interval in the width direction, and at one side of the first balance shaft 13, the driving gear 11 is engaged with the oil pump gear 110 and at the other side thereof, the driving transfer gear 23 is engaged with the driven transfer gear 23 of the second balance shaft 15. In this case, the oil pump assembly 100 is disposed at one side in an axial direction of the second balance shaft 15, thereby improving the spatial efficiency. In this structure, the backlash control between the oil pump gear 110 and the driving gear 11 of the first balance shaft 13 may be made to prevent a gear whine noise or a rattle noise from occurring.

Further, according to the balance shaft module in accordance with an exemplary embodiment of the present disclosure as described above, the pair of support rings 210 supporting both sides of the oil pump gear 110 and enclosing the outer circumferential surface of the oil pump shaft 120 is provided and the inner side thereof is provided with the thrust bearing 150, thereby remarkably isolating the irregular operation or the vibration of the oil pump gear even though the rotation angular acceleration of the engine is changed.

While this disclosure has been described in connection with what is presently considered to be practical exemplary embodiments, it is to be understood that the disclosure is not limited to the disclosed embodiments, but, on the contrary, is intended to cover various modifications and equivalent arrangements included within the spirit and scope of the appended claims.

What is claimed is:

1. A balance shaft module, comprising:

a balance shaft for receiving a driving force from a crankshaft of an engine by a driving gear and rotating inside a balance shaft housing;

an oil pump gear being geared with the driving gear to rotate along with the driving gear;

an oil pump shaft having the oil pump gear press-fitted therein and rotating as the oil pump gear rotates;

an oil pump assembly mounted in the oil pump shaft and pumping oil as the oil pump shaft rotates; and a thrust bearing interposed between, by contacting, inner side surfaces of the pair of support rings and both side portions of the oil pump gear, the thrust bearing mounted at the oil pump shaft, wherein a pair of support rings is provided at both side surfaces of the oil pump gear to support both side portions of the oil pump gear in the oil pump shaft.

2. The balance shaft module of claim 1, wherein the inner side surfaces of the pair of support rings have a groove into which the thrust bearing is inserted.

3. The balance shaft module of claim 1, wherein the oil pump shaft is mounted at one side in a width direction of an oil pump housing, and the other side in the width direction of the oil pump housing is provided with a mounting groove dented in an axial direction so that the driving gear of the balance shaft is inserted into the mounting groove to be engaged with the oil pump gear.

4. The balance shaft module of claim 3, wherein the oil pump housing is provided with a front cover covering one surface of the oil pump gear and the front cover extends in a width direction to form an axial one side surface of the mounting groove.

5. The balance shaft module of claim 4, wherein the pair of support rings is disposed on each side of the oil pump gear, respectively, and encloses an outer circumferential surface of the oil pump shaft to prevent bending or torsion of the oil pump shaft in a radial direction or a circumferential direction.

6. The balance shaft module of claim 5, wherein an axial gear cover extending in the axial direction is formed between the pair of support rings, and the pair of support rings and the axial gear cover are integrally formed to cover both side surfaces and an outer circumferential surface of the oil pump gear.

7. The balance shaft module of claim 6, wherein the pair of support rings includes:

a first support ring for covering one surface of the oil pump gear; and a second support ring for covering the other surface of the oil pump gear, and wherein the first support ring is integrally formed with the front cover.

8. The balance shaft module of claim 7, wherein the axial gear cover is provided with at least one ventilation hole opened in a radial outside.

9. The balance shaft module of claim 7, wherein the oil pump assembly includes:

a rotor shaft extending from the oil pump shaft toward the other side in the axial direction;

a rotor spline-coupled to the rotor shaft to rotate along with the rotor shaft; and a rotor housing enclosing the rotor.

10. The balance shaft module of claim 9, wherein one surface of the rotor housing is spaced apart from the second support ring at a predetermined interval and the rotor housing is integrally formed with the oil pump housing.

11. The balance shaft module of claim 10, wherein the oil pump housing and the balance shaft housing are coupled to each other in the axial direction and when the driving gear of the balance shaft housing is geared with the oil pump gear, a position of the oil pump housing moves to one side and the other side in a width direction to perform a backlash control.

12. The balance shaft module of claim 11, wherein the other surface of the oil pump housing is provided with an assembling protrusion protruding in the axial direction, the balance shaft housing is provided with an assembling hole to accommodate the assembling protrusion, and the assembling protrusion is fixedly mounted in the assembling hole so that the balance shaft housing is assembled in the oil pump housing.

13. The balance shaft module of claim 12, wherein the oil pump gear is provided with a plurality of opening holes opened in the axial direction along a circumferential direction.

14. The balance shaft module of claim 13, wherein the balance shaft includes:

a first balance shaft mounted with the driving gear and rotating along with a driving transfer gear mounted on an outer circumferential surface thereof; and a second balance shaft having a driven transfer gear rotating along with the driving transfer gear while being geared therewith mounted on an outer circumferential surface thereof, and the first balance shaft is disposed at the other side in the width direction of the oil pump housing and the second balance shaft is disposed at the other side in the axial direction of the oil pump housing.

15. The balance shaft module of claim 14, wherein the first balance shaft and the second balance shaft are each provided with a balance weight to control a weight balance when the crankshaft rotates.

* * * * *